United States Patent [19]

Andrews

[11] Patent Number: 4,549,116

[45] **Date of Patent: * Oct. 22, 1985**

[54] ELECTRIC ENERGY SAVING TWO-POSITION COMBINATION SWITCHING DEVICE

[76] Inventor: Peter Andrews, 190 Gebhardt Rd., Penfield, N.Y. 14526

[ * ] Notice: The portion of the term of this patent subsequent to Jan. 25, 1994 has been disclaimed.

[21] Appl. No.: 277,598

[22] Filed: Jun. 26, 1981

Related U.S. Application Data

[63] Continuation-in-part of Ser. No. 761,528, Jan. 24, 1977, abandoned, and a continuation-in-part of Ser. No. 738,227, Nov. 1, 1976, abandoned, Ser. No. 442,082, Feb. 12, 1974, Pat. No. 4,005,334, and Ser. No. 544,579, Jan. 27, 1975, abandoned, said Ser. No. 738,277, is a continuation-in-part of Ser. No. 442,082, and a continuation-in-part of Ser. No. 544,579, which is a continuation-in-part of Ser. No. 442,082, and Ser. No. 250,949, May 8, 1972, abandoned, said Ser. No. 442,082, and Ser. No. 250,949, each is a continuation-in-part of Ser. No. 240,605, Apr. 3, 1972, abandoned, which is a continuation-in-part of Ser. No. 025,994, Apr. 6, 1970, abandoned.

[51] Int. Cl.[4] ..... H05B 37/00; H05B 39/00; H05B 41/14

[52] U.S. Cl. ..... 315/200 R; 307/146; 315/64; 315/362; 315/DIG. 4

[58] Field of Search ..... 315/200 R, 74, 75, 76, 315/64, 67, 68, 362, 200; 307/146

[56] References Cited

U.S. PATENT DOCUMENTS

| | | | |
|---|---|---|---|
| 1,273,754 | 7/1918 | Emberger | 338/126 |
| 1,452,115 | 4/1923 | Herz | 338/215 |
| 1,452,115 | 4/1923 | Herz | 338/215 |
| 2,723,327 | 11/1955 | Gilbert | 200/155 R |
| 2,896,125 | 7/1959 | Morton | 315/272 |
| 3,009,071 | 11/1961 | Morton | 307/146 |
| 3,028,523 | 4/1962 | Seid | 315/71 |
| 3,028,525 | 4/1962 | Morton | 315/272 |
| 3,037,146 | 5/1962 | Slater | 315/200 |
| 3,062,986 | 11/1962 | Fritz et al. | 315/200 |
| 3,138,737 | 6/1964 | French | 315/200 X |
| 3,215,891 | 11/1965 | Fritz et al. | 315/50 |

*Primary Examiner*—Saxfield Chatmon

[57] ABSTRACT

In one form of the present preferred embodiment of the present invention it relates to a two-position feed-thru electric line cord piercing switching combination, of the rotary and even the rocker type, which saves electric energy by use of a half-wave diode rectifying means. The electric energy saving, two-position, combination switching means having only two electrical passing switching positions and thereby having no electrical "off" position. The switch will alternatingly provide either an electrical half-wave "dim" or an electrical full-wave "on" illumination to a single filament lamp, string of Christmas tree lamps and the like, and will even provide eight separate combinations, of one OFF and three separate illuminations, when electrically connected ahead of a, for example, conventional LEVITON rotary 4-position lamp socket switching means which uses a conventional 3-way incandescent lamp member which is removable inserted into the lamp socket portion thereof. MICRO, CHERRY, toggle, rocker, push-button and the like, line cord non-piercing two-position switches may be used in other forms of the combination switching device or invention. The half-wave diode rectifying means is electrically connected shuntingly between and/or across substantially to two electrical contact members of the conductor wire-piercing and the wire non-piercing type of switching means. This construction results in automatic elimination of the electrical "off" position for generally any type of 2-position "off" and "on" switching means.

38 Claims, 17 Drawing Figures

88
P

ELECTRIC ENERGY SAVING TWO-POSITION COMBINATION SWITCHING DEVICE

This application is a continuation-in-part of my copending application Ser. Nos. 761,528 and 738,227, now abandoned, and 442,082, now U.S. Pat. No. 4,005,334, and 544,579, now abandoned, filed respectively Jan. 24, 1977 and Nov. 1, 1976 and Feb. 12, 1974 and Jan. 27, 1975. The Ser. No. 738,227 filed application Nov. 1, 1976 is a continuation-in-part of my copending applications Ser. No. 442,082 filed Feb. 12, 1974, and Ser. No. 544,579 filed Jan. 27, 1975, which is a continuation-in-part of my two copending applications Ser. No. 442,082 filed Feb. 12, 1974 and Ser. No. 250,949, now abandoned, filed May 8, 1972, both of which were a continuation-in-part of my copending application Ser. No. 240,605 filed Apr. 3, 1972, now abandoned, which was a continuation-in-part application of my copending application Ser. No. 25,994 filed Apr. 6, 1970, now abandoned.

BACKGROUND OF THE COMBINATION INVENTION

1. Field of the combination invention

A 2-position, especially an electric line cord mounting type, switching means having a half-wave diode rectifier which is shuntingly electrically connected to two electrical contacts of the switching means to thereby cancel the electrical "off" position of a conventional 2-position "off" and "on" switching means so that when repeatedly actuating the switching means only an electrical half-wave "dim" and a full-wave "on" position is repeatedly possible, regardless of how a person manually actuates a switch actuation exposed portion thereof for at least obtaining eight separate combinations of one OFF and three separate illuminations from a 3-way lamp, saving money; extending the life of incandescent lamps especially when used with an electric lamp timer so that a house will not be as easily burglarized and the like.

2. Description of Some of the Prior Art

Prior art electrical "on" and "off" 2-position electrical conductor line cord switching means are well known by person skilled in the art and are a commonly used household item which is basically electrically connected in a twin or parallel electric conductor wire that runs from a double-pronged male plug to an electric lamp fixture and the like. The line cord switches are of the light duty type as, for example, a LEVITON "KWIK WIRE" miniature feed-thru cord switch of the line piercing type, that is sold under a stock number of 5669 by Sears, Roebuck and Co. Other prior art cord or line piercing type are J. M. LAPEYERE U.S. Pat. No. 2,802,083 which issued on Aug. 6, 1957 and Gilbert U.S. Pat. No. 2,723,327 which issued Nov. 8, 1955 and even a rotary, push-button electric cord 4-position switching device was invented by F. D. Bryant et al on Mar. 26, 1940 being U.S. Pat. No. 2,195,237. A very old prior art which does not relate to a 2-position "off" and "on" switching line cord means, but will generally show how old the line cord, rheostat heat creating and electric energy wasting, dimming art is, is that of F. Emberger U.S. Pat. No. 1,273,754 which issued on July 23, 1918. Even a, 2-position "on" and "off", rocker type of line cord piercing switch was patented by Luis Ludwig on Sept. 5, 1972 being U.S. Pat. No. 3,689,723, but was totally silent, as are all the disclosed prior art, as to having any half-wave diode rectifying means, especially a silicon type, for creating eight separate combinations of one OFF and three separate illuminations from a 3-way bulb, for saving electric energy, preventing some burglarizing by additional use of an electric utility timer and the like disclosed in the following objects of this invention.

A prior art R. C. Morton, U.S. Pat. No. 2,896,125 issued July 21, 1959 that uses a 2-position switch 56 having a diode 52 for dimming a single filament lamp 54 in a ceiling of a room, and points away from use of an expensive multi-filament lamps which are associated with complicated and relatively expensive sockets and switching circuits, as for example a 3-way lamp and its switching means.

U.S. Pat. No. 3,689,723 discloses therein and thereby it need not be repeated in this specification as to the popularity and the after market "(in the home)" installation of line cord switches as well as prior art disadvantages and the like in column 1 and 2, and accordingly also relates to the disclosed U.S. Pat. No. 2,723,327 therein.

A 9-position, 40 degrees apart, electric cord mounting switching means having 3 electrical "OFF" positions, 3 half wave diode "dim" and 3 full-wave positions has been used in a Sears catalog 1969 publication and called a "HI-LO" switching means that appears to be a trademark term only. The Sears, page 820, 9-position swtich is manufactured by Calcomp Consumer Products, Inc. Anaheim, Calif. 92806. The 9-position Sears switch creates a machine-gun switching disadvantage which is overcome by the disclosed and claimed two-position switch shown in FIG. 3 of the drawing of this application and especially by FIGS. 8 and 9 of Micro or Cherry switch embodiments.

SUMMARY OF THE INVENTION

The most important object of this two-position combination switching device is to save the life of 3-way bulbs or lamps having, for example, a 30, 70 and 100 watts of illumination or light intensities, will now be provided, as by providing the public with, as desired, the following *eight separate combinations of one OFF and three separate illuminations* which, is an UNKNOWN CONCEPT, when taken with the inherent "OFF" position of a 4-position switch for a 3-way lamp are:

1. "OFF"-full-wave 30 watt—full-wave 70 watt—full-wave 100 watt or low, medium and high
2. "OFF"-rectified low, rectified medium and rectified high
3. "OFF"-rectified low, rectified medium and full-wave high
4. "OFF"-rectified low, full-wave medium and full-wave high
5. "OFF"-full-wave low, full-wave medium and rectified high
6. "OFF"-full-wave low, rectified medium and rectified high
7. "OFF"-full-wave low, rectified medium and full-wave high
8. "OFF"-rectified low, full-wave medium and rectified high.

Another important object of the invention is to provide a two-position half-wave "dim" and full wave "on" only line cord switch which constitutes a minimum number of simple parts, is thereby very inexpensive to manufacture and is still rugged, reliable and highly durable in use, especially when a LEVITON "KWIK WIRE" miniature feed-thru cord switch no. 5669 need not be altered in any way when a cheap half-wave diode rectifying means is combined therein.

Another very important object of this invention, partly taken with the previous two objects, is to have a two-position "MICRO" or "CHERRY" type of switch having the diode rectifier in electrical connected combination therewith and which is housed in a lamp socket switching portion of a, for example, 4-position LEVITON lamp socket, for a 3-way lamp, of the key-switching type so that the low or medium or even both filaments of the lamp being half-wave "dimmed" especially when the timer is thereby actuated for at least half-wave dimming of both filaments of the 3-way lamp when the house is unoccupied, for at least discouraging burglars by having a 30–1 factor, at twice the illumination of a half-wave dimmed single filament lamp, against bulb burnout and a darkened house.

A still further important object, taken in-part with at least two of the above previous objects, is to have a rotary, push button, rocker, toggle or the like two-position combination switching means, having a half-wave diode in electrical connected combination therewith, and being electrically connected and substantially housed at least in a base portion of a 3-way table lamp fixture means with the switching means being in the switch's half-wave "dimmed" position so that the filaments of the 3-way lamp or a circular lamp socket insert fluorescent lamp means into a one-way socket means will be at least illuminated in a diode "dimmed" rectified state. The fluorescent lamp dimming being a FIRST by means of a half-wave diode in a two or three position switching means.

A still further another important object of my two-position electrical energy saving switching invention is to overcome the confusion which is created when a three-position electrical energy saving switching means, having an electrical "off", half-wave diode rectifying "dim" and a full-wave "on" position or even an electrical "off", "on" and half-wave "dim" position, as desired, is left in its electrical "off" position and later one or even two separate switching means being actuated and left also in its electrical "off" position. Thereby when a person actuates a wall switch, for example, the person is confused because the lamp will not illuminate. The person actuates the switch of the lamp socket and still the lamp will not illuminate. The person then must actuate the three-position cord switch, for example, and even then the lamp will not illuminate unless the wall switch and/or the lamp socket switch are left in their actuated "on" electrical position, for example.

Another further very important object of my two-position electric energy saving switching invention, taken with at least two of the above objects is to entirely eliminate an electrical "off" position so that the switch is never accidentally left in an electrical non-passing position especially when the switch is substantially housed in or is used in combination with an electric utility timing means, photoelectric switching means and the like for automatically creating an illuminating effect that discourages burglars thereby.

A yet further object of my electric energy saving and electrical switching confusing saving two-position switching invention, taken with the above object, is that further confusion is created by use of the nine (9) position Sears 1969 catalog, page 820, cord switch when a single filament lamp is inserted into a 4-position LEVITON, for example, lamp socket switching means, because the single filament lamp creates two electrical "off" switching positions before the lamp can be illuminated, when the lamp socket switching means is actuated. Thereby there are four electrical "off" positions in the above disclosed possible electrical circuit situation.

A further important object of my two-position electric energy saving switching invention, in at least one embodiment thereof, is to provide the simplest and cheapest possible switching means, as a whole, for the public to purchase since not one element or adjunct part thereof needs to be altered or manufactured whereby all tooling, moulding, dies, stamping of parts and the like are already done in that only a diode rectifier means need be electrically connected into or to the switch, in a desired or as deemed necessary location and/or configuration. The switch is thereby substantially ready for distribution and sale to the public, accordingly.

Other and further objects may be made apparent as the following detailed description of the two-position electric-energy switching means progresses, at least to one skilled in the art.

BRIEF DESCRIPTION OF THE DRAWINGS

FIG. 16 is a side elevational view of an electric cord mounting, rocker type, 2-position half-wave diode "DIM" and full-wave "ON" switch embodiment.

FIG. 17 is a side elevational view of a large "LEVITON" type of electric cord mounting 2-position half-wave diode "DIM" and full-wave "ON" switch embodiment.

DESCRIPTION OF THE PREFERRED EMBODIMENTS

Figure 1:
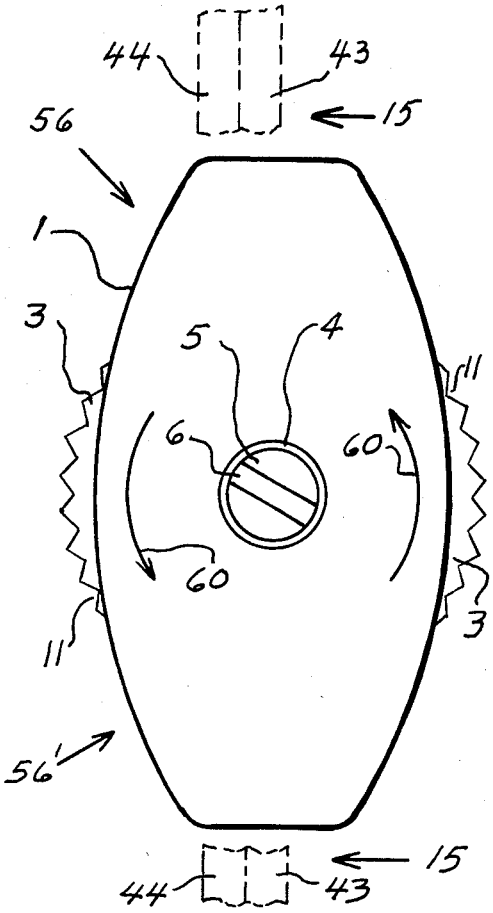
FIG. 1 is a top plan view of one of the various possible preferred embodiments of the, twin-wire electric cord or wire piercing, wheel actuating switch invention.
Figure 3:
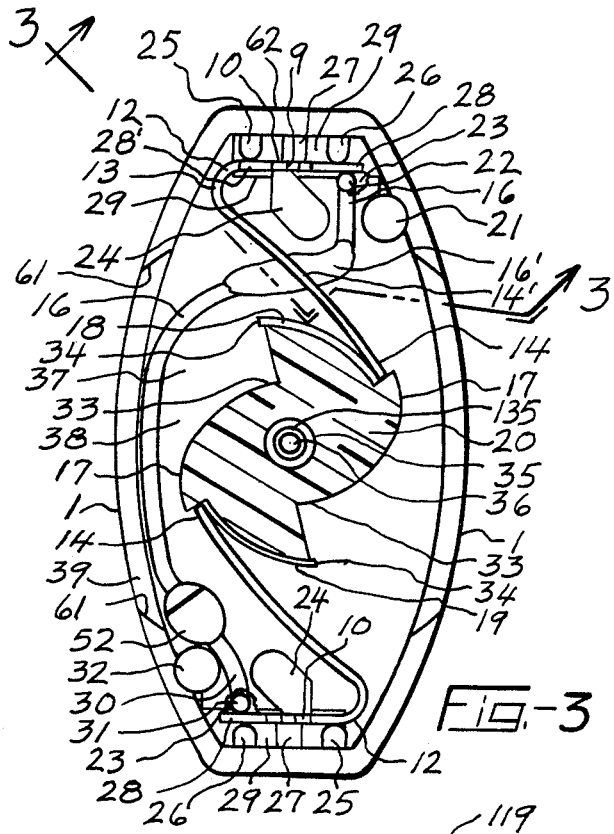
FIG. 3 is substantially a sectional view taken substantially along sectional line 2—2 of FIG. 2 with a cut-off portion of the switch actuation means therein to fully show one possible embodiment and arrangement of elements therein.

FIG. 1 shows the general shape of the burglar discouraging and electric energy saving two-position combination switching device 56 by arrow means. A generally conventional upper casing 1, conventional switch actuating wheel member 3 having serrations 11 on its outer diameter, counterbored opening 4, head of a metal screw means 5 having a screw driver slot 6 therein is also shown. A conventional metal nut (not shown) is preferred to be threaded onto the other end (not shown) of screw member 5, in the conventional way, for removably securing the device 56 onto twin-wire members 43 and 44 of a conventional electric cord member 15 which is shown by the dashed-line arrow means and which member 15 is generally shown in FIGS. 1 and 37 of copending application Ser. No. 442,082 and in FIG. 22 of Ser. No. 544,579 application. A threaded (not shown) end of screw 4 may also be threaded into opening 135 of center post 35 in the lower casing 2 portion as generally shown in FIG. 3, whereby the conventional threaded nut member may be eliminated, if so desired. The direction of wheel 3 rotation is indicated by arrow means 60. Shown in dashed-line outline are electrical conductor wire.

Figure 2:
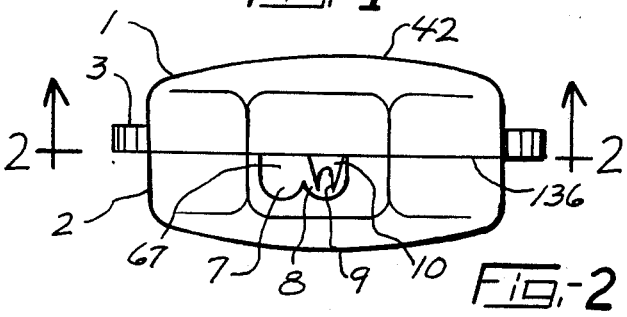
FIG. 2 is an end view of FIG. 1 switch invention showing the electric wire piercing points, and twin wire openings thereof.
Figure 4:
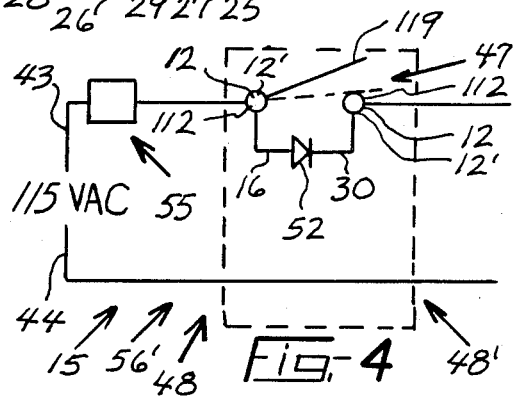
FIG. 4 is a partial improved schematic electric circuit combination embodying the two-position combination switching invention.
Figure 5:
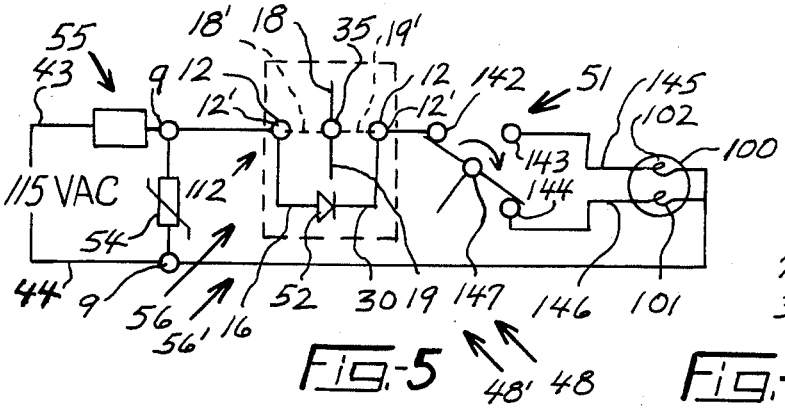
FIG. 5 is an improved schematic electric circuit combination invention whereby at least eight separate combinations of three illuminations are made possible by use of the two-position combination switching invention.

FIG. 2, end view of FIG. 1, shows the outer surface 42 of upper casing 1, generally conventional lower casing 2, sectional line 2—2, location of protruding portion of wheel member 3 in the upper casing 1 half-portion of device 56, the device's 56 generally half-casings 1 and 2 parting line 136, electrical conductor feed-thru twin-wire conventional openings 7 and 8 which are in each end portion of lower casing member 2 and a conventional electrical contact cord wire piercing tab-like member 10 having electrical wire piercing prongs 9 integrally thereon. Openings 7 substantially houses or receives a longitudinal portion of a first electrical conductor wire member 44, of a conventional electrical twin-wire electrical cord member 15, so that it can be fed through the lower casing 2 portion of device 56 and/or 56' in a conventional uncut way, as is generally shown in FIGS. 4 and 5. Openings 8 substantially houses or receives a cut in-half and thereby separated second electrical conductor wire member 43, of the same conventional electrical twin-wire cord member 15, so that the cut and separated portions of wire member 43 can be electrically connected by two separated wire piercing tab-like members 10 by means of the wire piercing prongs 9, as is generally shown in FIG. 2 of U.S. Pat. No. 3,689,723 wherein conductor wire 27 conventionally fed entirely through the casing 10 and the cut in-half conductor wire 26 is conventionally separated by an insulated wall portion of the casing 10, as is substantially in casing 2 or a LEVITON KWIK-WIRE MINIATURE FEED-THRU CORD SWITCH as sold by Sears, Roebuck and Co. by a stock No. 5669. The casing 1, 2 and the wheel member 3 with its integral cam 20, shown in FIG. 3, are constructed or moulded from a conventional electrical insulating material known to persons skilled in the art.

FIG. 3 shows the general location and arrangement of the various generally conventional elements which, as a single combined whole and being substantially housed in casing 1, is the heart of the combination invention or device 56.

The manually contacting and actuating portion of wheel member 3 is fragmentarily cut off so that at least the conventional integral camming portion 20, which has on its (not shown) underside a conventional one-piece electrical conducting member which has two upwardly formed electrical conducting ear-like members 18 and 19 mounted on two separate cammed portions thereof, can readily be viewed and understood especially by persons skilled in the art.

The integrally connected (not shown) electrical contacts 18 and 19 are in their full-wave "on" electrical passing position by having the two integral electrical conducting resilient ends 14, of two separated members 12, contacting thereon. When the cam 20 is rotated clockwise, from its shown resting position, the two separated ends 14 wipingly slide along an outer surface of moving contacts 18 and 19 until the outer end edge portions, of members 14, resiliently trip off of the two separated outer ends 34 of members 18 and 19, and rest against the insulated inner cammed portion 33 of the two longer cams 17. The improved combination device or switch 56 would ordinarily be in its electrical "off" position, but since the half-wave diode rectifying means 52 has one of its electrical conducting wire leads 16 and 30 shuntingly electrically connected by having their formed up ends 22 and 31 respectively soldered, spot welded, welded, and the like means 23, to the two separated integral generally stationary portions 28 of member 12. Thereby the electrical "off" position is positively cancelled, leaving the switch 56 in an electrical half-wave rectified passing position for illuminating at least one electrical incandescent lamp into a half-wave "dim" electrical energy saving and/or burglar discouraging state, and by merely using, for example, a ten cent (10¢) half-wave diode means 52.

Figure 6:
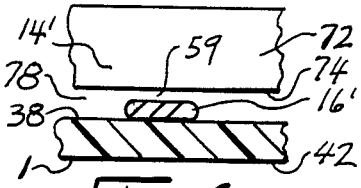
FIG. 6 is a sectional view partially or fragmentarily taken substantially along sectional line 3—3 of FIG. 3.
Figure 13:
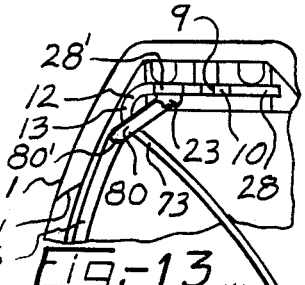
FIG. 13 is another possible preferred embodiment, in fragments, showing a partial top plan view of one fragmentary corner portion of substantially FIG. 3 embodiment.
Figure 12:
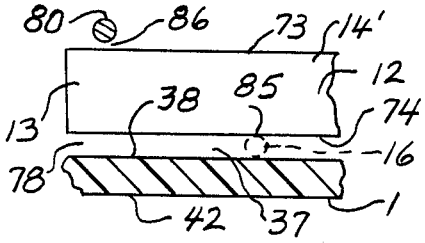
FIG. 12 is another sectional view, of a still further possible embodiment, from that shown in FIGS. 6, 7, 10 and 11, and also to be considered as being partially taken substantially along line 3—3 of FIG. 3, in view of FIG. 13.
Figure 14:
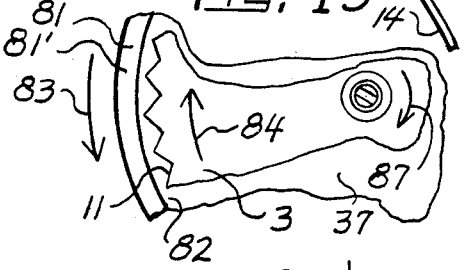
FIG. 14 is a fragmentary cut away top plan view of a wheel 3 protective integral cover portion of another embodiment of casing 1 and 2.
Figure 15:
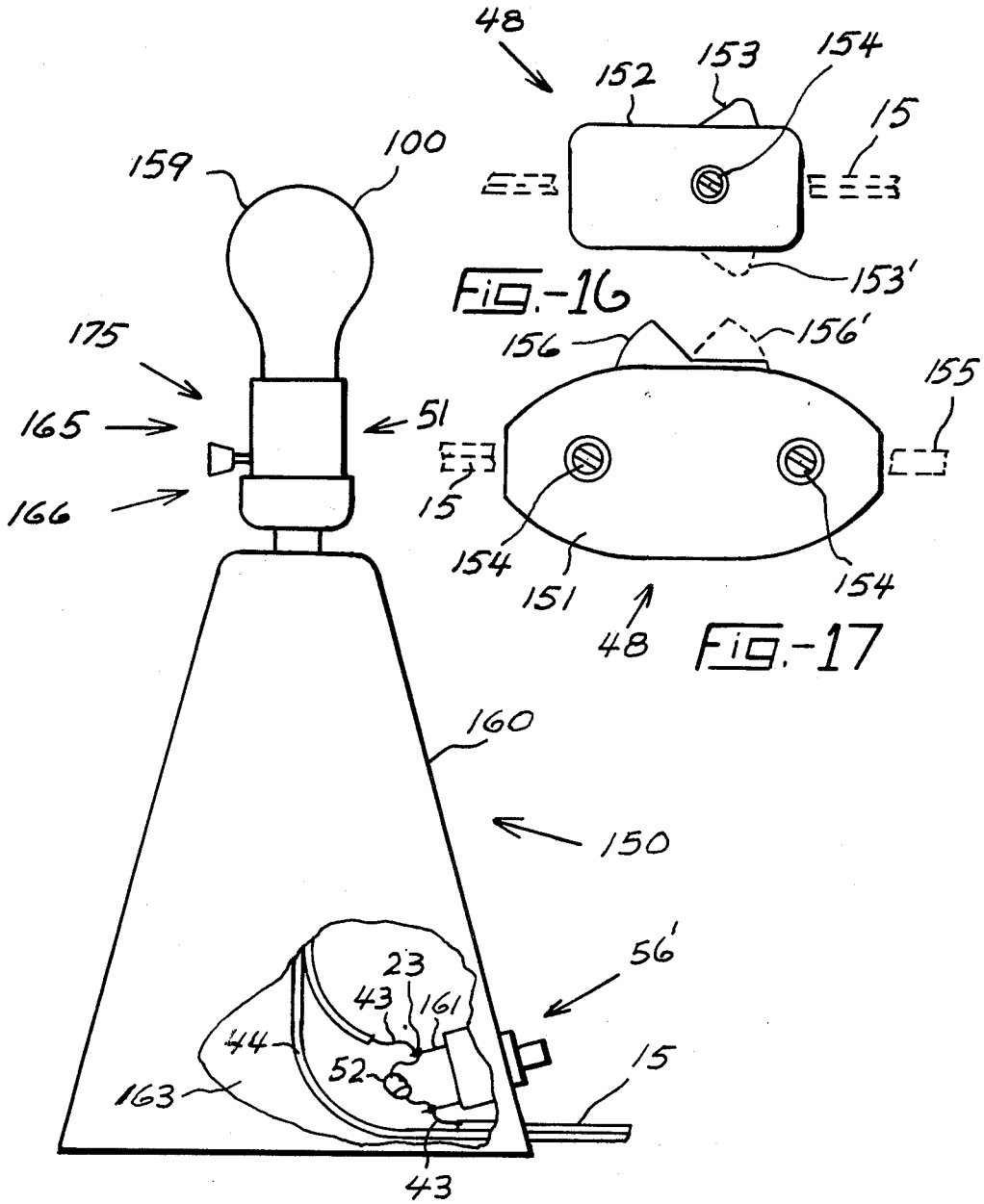
FIG. 15 is a side elevational view of a table lamp combination embodiment invention having a cut-away portion 163.

It should be noted that the shown switch 56 is made up of entirely conventional elements. Switch 56, without diode 52 is, in its entirety, the well known previously disclosed "LEVITON" stock No. 5669 two-position "on" and "off" feed-thru cord switch, without any structural alteration thereto. The only structural alteration of any element in switch 56 is made to one longitudinal portion of lead member 16 in that a portion thereof is generally coined or flattened 16' as is generally shown in FIG. 6 so that the underside 74 portion of the resiliently and horizontally moving generally center portion 14' of member 12 generally has a space 59 between the top surface of the flattened 16' portion of member 16. The lead wire 16 need not be altered or flattened 16' at all if the end of the lead wire 16 is formed up and over 80 as is generally shown in FIG. 13, if so desired, whereby substantially not one element or portion of switch 56 is structurally altered in any way.

Thereby, the switch 56 is generally one entity, as a whole, that shows simplicity of an improved combination invention, in its simplest possible form, for further providing the public with a very reliable, cheap, efficient, economical, convenient to mount two-position switch in a very facile way. Yet, switch 56 is already substantially miniaturized in size for pleasant mounted appeal to one's eye and also resulting in reduced energy cost for manufacturing as well as reduced cost of the material used for its casing 1 and 2 and for only one type of electrical contact member 12 to manufacture, store, purchase, handle and the like, all of which further adds to its simplicity and still further electric energy savings through at least one used means in the manufacturing portion thereof.

Referring back to FIG. 3 which shows two generally rear rigid bosses 25 and 26 and one generally front boss 24. The three bosses 24, 25 and 26 substantially support the generally non-resilient moving integral portion 28 and 28' of member 12 in a generally upstanding position on top of a lower raised boss 29. The web-like boss fits into a cutout (not shown) portion of member 12 and 27 is used for accurately positioning member 12 in cavity 37 in a conventional way. Shown is a curved 13 resiliently moving portion of member 12, curved end wall 61 of recess 39 which provides clearance for wheel 3 in casing 1 in a conventional way, half-wave diode rectifier means 52 which is of the preferred silicon glassivated (A14) and space permitting the (A15) type which is manufactured by General Electric Co., but other elongated tubular-like types of well known silicon diode rectifiers, to persons skilled in the art, may be used as desired or deemed necessary. However, the preferred glassivated diode 52 is of solid glass and provides passivation and protection of the silicon pellet's P-N junction. No organic material is present within the hermetically sealed package or diode 52 and the like advantages of even having rigid mechanical support by its dual heat sink construction well known to persons skilled in the art. Also shown are two upstanding pin-like members 21 and 32 which are used for accurately positioning the casings 1 and 2 together as is generally shown in FIGS. 1 and 2, and sectional line 3—3. Casing 1 and 2 conventional pins 21 and 32 are also shown.

Figure 8:
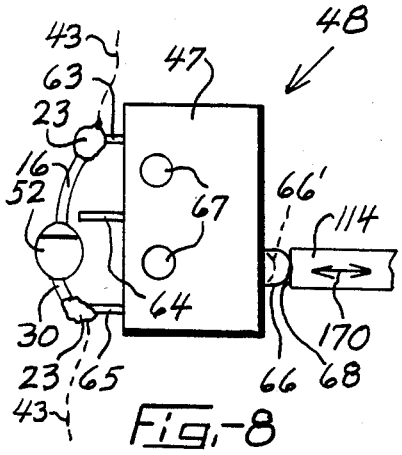
FIG. 8 is a side elevational plan view of another embodiment of the two-position combination switching invention.
Figure 9:
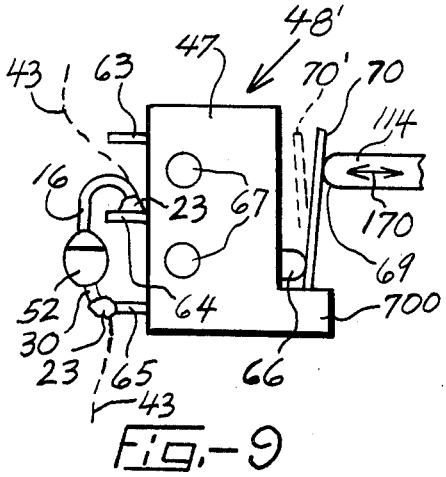
FIG. 9 is another side elevational plan view of still another embodiment of the two-position combination switching invention.
Figure 10:
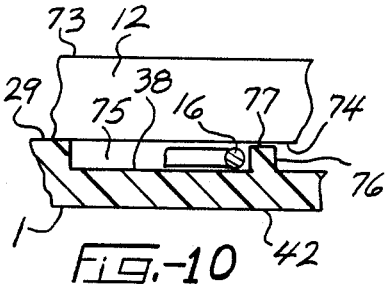
FIG. 10 is another sectional view, of still another embodiment, from that shown in FIGS. 6 and 7 and would be substantially taken partially along line 3—3 of FIG. 3.
Figure 11:
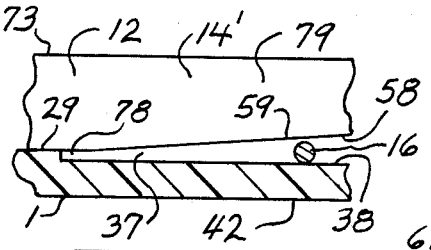
FIG. 11 is another sectional view, of a further possible embodiment, from that shown in FIGS. 6, 7 and 10 and also to be considered as partially taken substantialy along line 3—3 of FIG. 3.

In FIG. 4 the electrical conductor wire or line members 43 and 44 of twin electric cord member 15 are shown. A general Electric remote control relay 55 of the RR-3 type for 110 V.A.C. switching "on-off" sequence that is controlled by a 24 volt line and momentary contact "on-off" wall mounted switching means (not shown) known to persons skilled in the art is electrically connected in line 43 ahead of the switch 56' or even switching means 48 and/or 48' which are generally shown in FIGS. 8 and 9, for example, as desired or deemed necessary for their particular "in combination" application with a single element lamp (not shown) and/or a 3-way "LEVITON" lamp socket switching means 51 as is generally shown in FIGS. 5, 8 and 9. FIG. 4 shows a two-position 47 non-rotating "on" and half-wave "dim" switch 48 and/or 48' having electrical contacts 12 which integrally has the electric wire 43 one or two prongs 9 or even a mechanical, soldered, spot welded and the like 12' electrical contact and connection (not shown) as is desired or deemed necessary. For example, a rocker type, with or without electrical leads or terminals, of two-position switch of U.S. Pat. Nos. 3,689,723; 2,195,237; 2,529,848 issued Nov. 14, 1950 to E. H. Lockwood; U.S. Pat. No. 2,236,763 issued Apr. 1, 1941 to J. B. Peterson. Switch 56' being substantially the same as switch 56 except that it is a rotary, rocker, toggle, slide, push-push, slide, lever, Levolier, cherry and the like type of switching means still having only a two-position electrical half-wave diode "dim" and a full-wave "on" position. Switch 56', for example, may be constructed from a large rocker type of conventional ivory or brown colored LEVITON two-position electric cord switch having a machine screw type of connection which electrically connects two ends of wire 43 and/or leads 16 and 30 of diode 52.

The embodiment 56' may have a rotary rod-like member extending from a face edge portion of the 2-position switching device's insulating housing having casing member 1 and 2. The rod-like member may have a knob-like member thereon (not shown here) but is generally shown at least in drawing FIGS. 10, 11, 13 and 14 of Ser. No. 544,579 application filed Jan. 27, 1975. The Ser. No. 544,579 FIGS. 10, 11, 13 and 14 are copendingly dated back through Ser. Nos. 442,082; 240,605 and Ser. No. 25,949 application which was filed Apr. 6, 1970.

The rod-like member 18 and knob-like member 4 of the Ser. Nos. 544,579 and 25,994 applications are also shown in drawing FIG. 21 embodiment of the Ser. No. 544,579 application.

The rod-like member 18 and knob-like member 4 are fully disclosed, for example, in pages 14, 23, 28, 34, 35, 40 and 41 of the Ser. No. 544,579 application as to their conventional manual rotating switching uses, especially for an electric cord 15 mounted electrical full-wave 118 and/or a half-wave dimming device 117 of an electric incandescent lamp, as is generally shown, for example, in FIGS. 10, 11 and 21 of Ser. Nos. 25,949 and 544,579 applications respectively.

FIG. 4 further shows electrical wire lead 16, diode 52, second lead 30, switch 56', switch arm 119 in its "open" half-wave "dim" electrical position, switch 48, 48' and 56' by arrow means designation.

FIG. 5 shows a unique electrical circuit combination for creating the eight separate combinations of three separate illuminations which is impossible with the Sears 9-position switch and also shows the electric lines or wires 43 and 44; relay 55; wire 43 and 44, electric contact member 12 and 12', of one OFF cord member 15 and mounting varistor device 54 which has a general overall outside shape of the switch 56 of FIG. 1, without wheel member 3 and its opening 39, as is generally shown in FIG. 36 of the drawing of Ser. No. 442,082, and Ser. No. 240,605 and being mounted on a twin-wire electric cord 15. The "GE-MOV" varistor two electric wire 43 and 44 prong piercing device 54 having a metal oxide varistor material such as that described in Canadian Pat. No. 831,691 and U.S. Pat. No. 3,821,686 issued June 28, 1974 and/or Pat. No. 3,811,103 issued May 14, 1974 as desired or deemed necessary. Shown in FIG. 5 is relay 55; member 12 or the mechanical, soldered, spot welded, etc. electrical connection 12'; switch 56; wheel 3 pivoting post 35; closed "on" 18 and 19 and half-wave diode 52 "dim" position of generally the rotating switch contact members 18' and 19' against the electrical contact member 12, substantially as a whole.

FIG. 5 further shows substantially the wire 43 leaving switch 56 or 56' or even switch 48 or 48' which is shown in FIGS. 8 and 9 as the case may be and as desired or deemed necessary and electrically contacting the electrical contact 142 of the conventional 4-position LEVITON lamp socket switching means 51. It should be noted that the switching means 51 and the switch 48 and 48' are to be electrically connected and both combined within the LEVITON 4-position switching lamp socket means or even in a 4-position switching Levolier type of lamp socket means as is generally shown in FIGS. 21, 22, 23, 24, 25 and 26 of Ser. No. 442,082 copending application.

The 4-position switch 51 shown in its OFF position in FIG. 1 of applicant's copending application Ser. No. 761,665 filed Jan. 24, 1977 now being U.S. Pat. No. 4,117,376 and also shown in FIG. 9 of applicant's copending Ser. No. 442,082 application now U.S. Pat. No. 4,005,334.

Further in FIG. 5 the 4-position switching means 51 shows electrical contacts 142, 143 and 144 and armature or pivot 147; electrical connections or wires 145 and 146; 3-way bulb 100 having low and medium filament members 101 and 102 respectively therein that are electrically connected substantially in effect to wire member 44.

Thereby, when a person substantially actuates the switches 56, 56', 48 and/or 48' and manually manipulates the 4-position switching means 51, then the disclosed eight separate combinations of one OFF and three separate illuminations are thereby made possible. FIG. 5 shows lamp 100 in its electrical half-wave "low-dimmed" illuminated state by having the "low" filament 101 in its half-wave "dimmed" electrical state by means of diode 52.

FIG. 6 generally shows a preferred clearance 59 between the underside 74 of the generally resiliently horizontally moving middle 14' portion of member 12 and a top surface portion of the flattened 16' portion of diode 52 lead wire 16. Also shown in the inside cavity wall 38 and outside wall 42 portion of casing 1.

Figure 7:
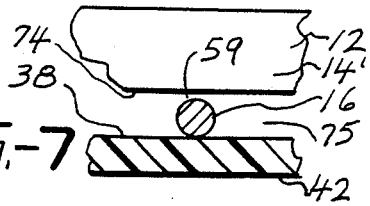
FIG. 7 is another sectional view, of another possible embodiment, from that shown in FIGS. 6 and would be partially taken substantially along line 3—3 of FIG. 3.

FIG. 7 shows another generally preferred partial embodiment change from that of FIG. 6 and FIG. 3 in that the switch 56 casing 1 is constructed in such a way that there is a space 59 between the top of lead wire 16 and the bottom portion of member 12 in at least its 14' resiliently moving portion so that there is no mechanical sliding and/or interference between the 14' portion of member 12 and a top surface of lead wire 16, when the end 14 of member 12 snaps off of the end 34 of members 18 against the insulated surface 13 portion of cam 17 as is generally shown in FIG. 3.

FIG. 8 shows another embodiment of this two-position "dim" and "on" switching means. Shown is a two-position "CHERRY" or "MICRO" type of switching means 48 which may be electrically connected so that it is in its initial half-wave diode 52 rectifying electrical passing "dim" state to an electrical incandescent lamp, when end of wire 30 and an end of wire 43 is soldered 23 only to terminal 64, as when the switch depressing button 66 is not depressed, and will be in its full-wave electrical passing "on" state when the button 66 is depressed to its moved 66' dashed line position by use of, for example, an axially manually moved 170 rod-like member 114. Member 114 is shown as being an end portion of the rod-like switch rotating member 118 of drawing FIGS. 25 and 30 of Ser. No. 442,082 application. Conventional switch 47 is in electrically connected combination with diode 52 for creating combination switching device 48. Shown are conventional second electrical terminals 63, 64 and common first terminal 65. Diode 52 is electrically shuntingly connected to terminal 63 and 65 to provide an electrical full-wave electrical "on" and then a half-wave rectified "dim" passing means to a single filament lamp 9 or to a 3-way lamp as is generally shown in FIGS. 7 and 9 of Ser. No. 442,082 application and/or to a 3-way lamp 100 as is generally shown in FIG. 5 of this application. If the soldered 23 end of lead wire member 30 is electrically connected to terminal 64 then the switching device 48 would be in its initial full-wave "on" and then in its button 66 depressed 66' half-wave "dim" electrical passing state. Shown are switch 48 two mounting holes 67 and electrically interrupted wire 43 in dashed-line outline and the generally flat end 68 of member 114.

FIG. 9 shows another type of "CHERRY" or "MICRO" switching means 48' which has a button 66 depressing lever 70 and the switches 47 extension boss-like member 72 for pivotly captively retaining an end of member 70 therein. The rod-like member 114 having a preferred radius end 69 portion which is axially 70 forced against lever 70 for moving it to its dashed-line 70' position. Thereby button 66 is depressed for placing switch 48' in its full-wave "on" electrical passing position. End of lead wire 16 may, as desired, be soldered 23 along with an end of wire 43 to terminal 63 so that switch 48' would then be in its initial full-wave electrical "on" passing position, as in FIG. 8, for example.

FIG. 13 shows a very preferred another possible embodiment or arrangement of the electrical connection of wire member 16 to the generally rigid tab-like 28' portion of member 12 so that there is substantially no structural alteration of switch 56 or any of its space or even any of the element members therein, or even the flattening 16' of lead wire 16, for creating the improved switch 56, as a whole. The substantially formed up 80' and substantially horizontally formed end portion 80 of lead wire 16 is in clearingly spanning relationship to a curved 13 upper edge portion 73 of member 12. The formed end portion 80 has its outer end electrically connected or soldered 23 to a substantially rigid tab-like 28' integral portion of member 12 so that the resilient switching function of the resiliently moving portion 13, 14' and end 14 of member 12 is not impaired from that for which the disclosed resilient portions of member 12, as a whole, were originally designed to perform for the electrical switching operation of switch 56.

The above is substantially the main reason or object for electrically connecting the formed up end 22, of wire 16, to the generally rigid tab-like end 28 of member 12, as shown in FIG. 3. However, a portion of the diameter of wire 16 had to be altered by a coining or flattening 16' extra operation in FIG. 3. Tab-like member 10 having the conventional two prongs 9 which could be reduced to only one prong 9, if so desired, is also shown.

In view of the foregoing it will be seen that the objects and advantages of the various disclosed embodiments of the two-position electrical "on" and half-wave "dim" switching invention are obtained or an electrical half-wave "dim" and full-wave "on" positions may be obtained, as desired.

It will be understood that the invention is not to be limited to the exact constructions shown and described, but that various changes and modifications may be made without departing from the spirit and scope of the invention, as defined in the appended claims.

I claim:

1. An electric energy saving two-position electric switching device having no electrical "off" position and having only an electrical half-wave "dim" and a full-wave "on" position for electrical connection to a two-conductor wire member of an electric cord member, comprising in combination: an electric insulating housing having an upper casing portion and a lower casing portion for being juxtapositioningly mounted by a securing means on said cord member; said upper casing portion having housed therein a one-piece first electrical contact member and a second electrical contact member each of which is formed from a resilient electrical conducting material, a half-wave diode electric rectifying means and a one-piece rotatable electric current conducting contact member; said upper casing portion also having a manually operable switch actuation means substantially housed therein for operatively actuating a pivotly mounted rotatable member having an electric insulating switching portion integrally formed on substantially one end portion of said actuation means; said switching portion having said conducting contact member substantially retained to at least one portion thereof for electrical switching rotation therewith so that when it is in its alternatingly first switched position said conducting contact member is electrically connected to said first said contact member and said second said contact member and when it is in its second switched position said conducting contact member is not electrically connected to said first said contact member and said second said contact member so that only an electrical full-wave "on" and a half-wave electrical rectified "dim" position is thereby obtained by having said rectifying means electrically connected to said first said contact member and said second said contact member; said lower casing portion having a substantially channel-like opening entirely through two outer end wall portions thereof for removably receiving a longitudinal portion of said two-conductor wire member having a first wire member and a second wire member therein; said lower casing portion will substantially house therein one uncut said first wire member and said second wire member which has a first and a second cut and separated wire end portions; said first cut end portion will be electrically connected by an electric wire connecting means to a portion of said first said contact member, and said second cut end portion will be electrically connected by an electrical wire connecting means to a portion of said second said contact member; said electric two-position switching device is so constructed and arranged that when it is electrically connected and mounted on said cord member and is in electrical connected combination with and ahead of a 4-position electric switching means having an electrical "off", low, medium and high switching positions for a 3-way incandescent lamp then eight separate combinations of one OFF and three separate illuminations may be provided by said 3-way said lamp without having any electrical OFF position in between any of said separate combinations.

2. In the combination of claim 1 wherein said switch actuation means being a rotatable wheel member means.

3. In the combination of claim 2 wherein said wheel member means having serrations on its outer diameter portion.

4. In the combination of claim 1 wherein said switch actuation means being a rod-like member means which extends axially and transversely through an outer face edge portion of said housing.

5. In the combination of claim 4 wherein said rod-like member means having a knob-like member means thereon for indirectly more conveniently and easily manually switchingly rotating said conducting contact member.

6. In the combination of claim 1 wherein said lower casing member having an integral partition portion means which is interposed between said first and said second cut and separated wire end portions for insulatingly preventing at least one said separated wire end portions from being electrically substantially reconnected.

7. In the combination of claim 1 wherein said wire connecting means being an integral electric wire insulation-piercing points of said first and second said contact member; said points are forced against at least one wire member portion of said first and said second cut and separated wire end portions for making electrical contact therewith when said upper casing portion and said lower casing portion are juxtapositioningly mounted on said cord member by said securing means.

8. In the combination of claim 1 wherein said wire connecting means being integral electric wire insulation piercing points of said first and said second said contact member; said points are electrically connected to said first and said second said wire end portions by being soldered to at least one electric current conducting wire portion of said first and said second said wire end portions.

9. In the combination of claim 1 wherein said wire connecting means being a spot welded connecting means to at least one electric current conducting wire portion of said first and said second said wire end portions.

10. In the combination of claim 1 wherein said wire connecting means being an integral tab-like member of said first and said second said contact member; said tab-like member being electrically connected to said first and a said second said wire end portions by being soldered to at least one electric current conducting wire portion of said first and said second said wire end portions.

11. In the combination of claim 1 wherein said wire connecting means being an integral tab-like member, having an opening through one portion thereof, of said first and said second said contact member; said tab-like member being electrically connected to said first and said second said wire end portions by being mechanically connected to at least one electric current conducting wire portion of said first and said second said wire end portions by use of a headed screw means which is threaded into said opening of said tab-like member while having a longitudinal portion of said first and said second said wire end portions between said headed portion of said screw means and a face portion of said tab-like member.

12. In the combination of claim 1 wherein said upper casing portion and said lower casing portion are juxtapositioningly removably mounted on said two-conductor wire member by use of one threaded screw means.

13. In the combination of claim 12 wherein said upper casing portion and said lower casing portion are juxtapositioningly removably mounted on said two-conductor wire member by use of one threaded screw and nut means.

14. In the combination of claim 1 wherein said upper casing portion and said lower casing portion are juxtapositioningly mounted on said two-conductor wire member by use of one rivet means.

15. An electric energy saving two-position switching device having no electrical "off" position and which is in electrical connected combination with one electric conducting wire member of substantially an electrical cord member which is electrically connected to an electric incandescent table lamp fixture switching means which is a 4-position electric switching means for a 3-way incandescent lamp, comprising in combination: said electric said two-position switching device is substantially housed in a base portion of said fixture; said device having at least one single throw switching means and having a first and at least one second electrical conducting terminal member extending from an electric insulating housing portion thereof and having a switch actuation member extending from another portion thereof; said first and said second said conducting terminal member having a half-wave diode electric rectifying means electrically connected thereto for alternatingly providing a half-wave electric rectified "dim" and an electric full-wave "on" position of said switching device when said actuation member is manually actuated; said switching device being in electrical connected combination with said 4-position electric switching means having an electrical "off", low, medium and high switching positions for said 3-way incandescent lamp is so constructed and arranged that eight separate combinations of one Off and three separate illuminations, without having any electrical OFF position between any of said separate combinations, may be provided by said 3-way said lamp.

16. An electric energy saving two-position switching device for electrical connected combination with at least one portion of an electrical conducting member of an electric incandescent lamp fixture switching means and for mounted combination with at least one portion of an electric incandescent lamp socket insulating member, comprising in combination: an electric two-position switching means of the "CHERRY" or "MICRO-SWITCH" type having at least one single throw switching means and having a first and at least one second electrical conducting terminal member extending from an electric insulating housing portion thereof and having a switch actuation button member extending from another portion thereof; said first and said second said terminal member having a half-wave diode electric rectifying means electrically connected thereto for alternatingly providing a half-wave electric rectified "dim" and an electric full-wave "on" position of said switching device when said button member is manually indirectly depressed and released substantially into and out of a portion of said housing portion by use of an end portion of an axially manually moved rod-like member of said lamp fixture switching means; said switching device is so constructed and arranged that when it is in electrical connected combination with and ahead of a 4-position electric switching means having an electrical "off", low, medium and high switching positions for a 3-way incandescent lamp then eight separate combinations of one OFF and three separate illuminations, without having any electrical OFF positions in between any of said separate combinations, may be provided by said 3-way said lamp.

17. In the combination of claim 16 wherein said button member is partially depressed and then released substantially into and out of a portion of said housing portion by having one end portion of a lever member pivotly mounted in a portion of said housin portion; said button will be partially depressed substantially into and substantially out of said surface portion of said housing by a moving surface portion of said lever member which is partially interposed between an outer surface portion of said button member and said end portion of said rod-like member so that when said end portion of said rod-like member is axially manually moved against and substantially away from another surface portion of said lever member then said button member will be partially depressed substantially into and released substantially out of a portion of said housing portion.

18. In the combination of claim 15 wherein said switching device is a rocker type of two-position said electric rectified "dim" and said full-wave "on" said switching device.

19. In the combination of claim 15 wherein said switching device is a toggle type of two-position said electric rectified "dim" and said full-wave "on" said switching device.

20. In the combination of claim 15 wherein said switching device is a slide type of two-position said electric rectified "dim" and said full-wave "on" switching device.

21. In the combination of claim 15 wherein said switching device is a lever type of two-position said electric rectified "dim" and said full-wave "on" said switching device.

22. In the combination of claim 15 wherein said switching device is a push-button type of two-position said electric rectified "dim" and said full-wave "on" said switching device.

23. In the combination of claim 15 wherein said switching device is a rotary type of two-position said electric rectified "dim" and said full-wave "on" said switching device.

24. An electric energy saving two-position electric switching device having no electrical "off" position and having only an electrical half-wave "dim" and a full-wave "on" position that is in electrical connected combination with a two-conductor wire member of substantially an electric cord member which is electrically connected to an electric incandescent table lamp fixture means having a 4-position switching means for a 3-way incandescent lamp, comprising in combination: an electric insulating housing having an upper casing portion and a lower casing portion for being juxtapositioningly mounted by an electric cord switch securing means on said cord member; said upper casing portion having housed therein a one-piece first electrical contact member and a second electrical contact member each of which is formed from a resilient electrical conducting material, a half-wave diode electric rectifying means and a one-piece rotatable electric current conducting contact member; said upper casing portion also having a manually operable switch actuation means substantially housed therein, for manually operatively actuating a pivotly mounted rotatable member having an electric insulating switching portion integrally formed on substantially one end portion of said actuation means; said switching portion having said conducting contact member substantially retained to at least one portion thereof for electrical switching rotation therewith so that when it is in its alternatingly first switched position said conducting contact member is electrically connected to said first said contact member and said second said contact member and when it is in its second switched position said conducting contact member is not electrically connected to said first said contact member and said second said contact member so that only an electrical full-wave "on" and a half-wave electrical rectified "dim" position is thereby obtained by having said rectifying means electrically connected to said first said contact member and said second said contact member; said lower casing portion having a substantially channel-like opening entirely through two outer end wall portions thereof for removably receiving a longitudinal portion of said two-conductor wire member having a first wire member and a second wire member therein; said lower casing portion will substantially house therein one uncut said first wire member and said second wire member which has a first and a second cut and separated wire end portions; said first cut end portion will be electrically connected by an electric wire connecting means to a portion of said first said contact member, and said second cut end portion will be electrically connected by an electrical wire connecting means to a portion of said second said contact member; said electric two-position switching device being in electrical connected combination with said 4-position switching means is so constructed and arranged that eight separate combinations of one OFF and three separate illuminations may be provided by said 3-way said lamp without having any electrical "OFF" position between any of said separate combinations, and also for discouraging burglars from entering an otherwise darkened house since said lamp has a substantially 30-1 burn-out factor at generally twice the illumination of a single dimmed filament member when two filaments of said 3-way said lamp are in their electrical half-wave rectified "dim" illuminated state and especially if an electric utility timer means is used by having said cord member plugged thereinto when the house is unattended at night.

25. In the combination of claim 15 wherein said switching device being in electrical connected combination with said fixture switching means which is a two-position "ON-OFF" means for a single filament incandescent lamp whereby at least 4 separate combinations of illuminations may be provided and being "OFF", half-wave "DIM" and full-wave "ON"; "OFF", full-wave "ON" and half-wave "DIM"; "OFF" and full-wave "ON"; "OFF" and half-wave "DIM".

26. An electric energy saving two-position switching device for electrical connected combination with at least one portion of an electrical conducting member of an electric incandescent lamp fixture switching means and for mounted combination with at least one portion of an electric incandescent lamp socket insulating member, comprising in combination: an electric two-position switching means of the "CHERRY" or "MICRO-SWITCH" type having at least one single throw switching means and having a first and a second electrical conducting terminal member extending from an electric insulating housing portion thereof and having a switch actuation button member extending from another portion thereof; said first and said second said terminal member having a half-wave diode electric rectifying means electrically connected thereto for alternatingly providing an electric full-wave "on" and a half-wave electric rectified "dim" position of said switching device when said button member is manually indirectly depressed and released substantially into and out of a portion of said housing portion by use of an end portion of an axially manually moved rod-like member of said lamp fixture switching means; said switching device is so constructed and arranged that when it is in electrical connected combination with and ahead of a 4-position electric switching means having an electrical "off", low, medium and high switching positions for a 3-way incandescent lamp then eight separate combinations of on OFF and three separate illuminations, without having any electrical OFF positions between any of said separate combinations, may be provided by said 3-way said lamp.

27. In the combination of claim 26 wherein said single throw switching means having a third electrical conducting terminal member extending from said insulating housing; said second said terminal member being between said first and said third said terminal member.

28. An electric energy saving two-position switching device for electrical connected combination with at least one portion of an electrical conducting member of an electric incandescent lamp fixture switching means and for mounted combination with at least one portion of an electric incandescent lamp socket insulating member, comprising in combination: an electric two-position switching means of the "CHERRY" or "MICRO-SWITCH" type having at least one single throw switching means and having a first and a second electrical conducting terminal member extending from an electric insulating housing portion thereof and having a switch actuation button member extending from another portion thereof; said first and said second said terminal member having a half-wave diode electric rectifying means electrically connected thereto for alternatingly providing a half-wave electric rectified "dim" and an electric full-wave "on" position of said switching device when said button member is manually indirectly depressed and released substantially into and out of a portion of said housing portion by use of an end portion of an axially manually moved rod-like member of said lamp fixture switching means; said switching device is so constructed and arranged that when it is in electrical connected combination with and ahead of a 4-position electric switching means having an electrical "off", low, medium and high switching positions for a 3-way incandescent lamp then eight separate combinations of one OFF and three separate illuminations, without having any electrical OFF positions between any of said separate combinations illuminations, may be provided by said 3-way said lamp.

29. In the combination of claim 28 wherein said single throw switching means having a third electrical conducting terminal member extending from said insulating housing; said third said terminal member being between said first and said second said terminal member.

30. An electric energy saving two-position switching device for electrical connected combination with at least one portion of an electrical conducting member of an electric incandescent lamp fixture switching means and for mounted combination with at least one portion of an electric incandescent lamp socket insulating member, comprising in combination: an electric two-position switching means of the "CHERRY" or "MICRO-SWITCH" type having at least one single throw switching means and having a first, second and third electrical conducting terminal member extending from an electric insulating housing portion there of and having a switch actuation button member extending from another portion thereof; said second and said third said terminal member having a half-wave diode electric rectifying means electrically connected thereto for alternatingly providing an electric full-wave "on" and a half-wave electric rectified "dim" position of said switching device when said button member is manually indirectly depressed and released substantially into and out of a portion of said housing portion by use of an end portion of an axially manually moved rod-like member of said lamp fixture switching means; said switching device is so constructed and arranged that when it is in electrical connected combination with and ahead of a 4-position electric switching means having an electrical "off", low, medium and high switching positions for a 3-way incandescent lamp then eight separate combinations of one OFF and three separate illuminations, without having any electrical OFF positions between any of said separate combinations, may be provided by said 3-way said lamp.

31. In the combination of claim 26 wherein said button member is partially depressed and then released substantially into and out of a portion of said housing portion by having one end portion of a lever member pivotly mounted in a portion of said housing portion; said button will be partially depressed substantially into and substantially out of said surface portion of said housing by a moving surface portion of said lever member which is partially interposed between an outer surface portion of said button member and said end portion of said rod-like member so that when said end portion of said rod-like member is axially manually moved against and substantially away from another surface portion of said lever member than said button member will be partially depressed substantially into and released substantially out of a portion of said housing portion.

32. In the combination of claim 28 wherein said button member is partially depressed and then released substantially into and out of a portion of said housing portion by having one end portion of a lever member pivotly mounted in a portion of said housing portion; said button will be partially depressed substantially into and substantially out of said surface portion of said housing by a moving surface portion of said lever member which is partially interposed between an outer surface portion of said button member and said end portion of said rod-like member so that when said end portion of said rod-like member is axially manually moved against and substantially away from another surface portion of said lever member then said button member will be partially depressed substantially into and released substantially out of a portion of said housing portion.

33. An electric energy saving two-position switching device for electrical connected combination with at least one portion of an electrical conducting member of an electric incandescent lamp fixture switching means and for mounted combination with at least one portion of an electric incandescent lamp socket insulating member, comprising in combination: an electric two-position switching means of the "CHERRY" or "MICROSWITCH" type having at least one single throw switching means and having a first, second and third electrical conducting terminal member extending from an electric insulating housing portion thereof and having a switch actuation button member extending from another portion thereof; said second and said third said terminal member having a half-wave diode electric rectifying means electrically connected thereto for alternatingly providing a half-wave electric rectified "dim" and an electric full-wave "on" position of said switching device when said button member is manually indirectly depressed and released substantially into and out of a portion of said housing portion by use of an end portion of an axially manually moved rod-like member of said lamp fixture switching means; said switching device is so constructed and arranged that when it is in electrical connected combination with and ahead of a 4-position electric switching means having an electrical "off", low, medium and high switching positions for a 3-way incandescent lamp then eight separate combinations of one OFF and three separate illuminations, without having any electrical OFF positions between any of said separate combinations, may be provided by said 3-way said lamp.

34. In the combination of claim 24 wherein said wire connecting means being intergral electric wire insulation piercing means of said first and second said contact member, said piercing means being forced against at least one wire member portion of said first and said second cut and separated wire end portions for making electrical contact therewith when said upper casing portion and said lower casing portions are juxtapositioningly mounted on said cord member by said securing means.

35. An electric energy saving rocker type two-position electric switching device having no electrical "off" position and having only an electrical half-wave diode rectified "dim" and a full-wave "on" position for electrical connection to one wire member of a two-conductor wire member of an electric cord member, comprising in combination: an electric insulating housing having an upper casing portion and a lower casing portion for being juxatpositioningly mounted by securing means on said cord member; said insulating housing having housed therein a first electrical contact member and a second electrical contact member, a half-wave diode rectifying means and an electric current conducting contact member; said housing also having a manually operable switch actuation means substantially housed therein for operatively actuating said contact member so that when said contact member is alternatingly rocked first switched position said conducting contact member is electrically connected to said first said contact member and said second said contact member and when said conducting contact member is in its second switched position said conducting contact member is not electrically connected to said first and said second said contact member so that only an electrical full-wave "on" and a half-wave diode rectified "dim" position is thereby obtained by having said electric rectifying means electrically connected to and between said first said contact member and said second said contact member; said housing having an electric cord receiving opening through two outer end wall portions thereof for receiving a longitudinal portion of said two-conductor wire member having a first wire member and a second wire member therein; said housing will house therein one uncut said first wire member and said second wire member which has a first and a second cut and separated wire end portions; said first end portion will be electrically connected by an electric wire connecting means to a portion of said first contact member and said second end portion will be electrically connected by an electrical wire connecting means to a portion of said second said contact member; said electric two-position switching device is so constructed and arranged that when it is electrically connected and mounted on said cord member and is in electrical connected combination with a 4-position electric switching means having an electrical "off", low, medium and high switching positions for a 3-way incandescent lamp then eight separate combinations of one OFF and three separate illuminations may be provided by said 3-way said lamp without having any electrical OFF position between any of said separate combinations.

36. In the combination of claim 35 wherein said wire connecting means being an integral electric wire insulation piercing means of said first and said second said contact member; said piercing means being forced against at least one wire member portion of said first and said second cut and separated wire end portions for making electrical contact therewith when said upper casing portion and said lower casing portions are juxatpositioningly mounted on said cord member by said securing means.

37. In the combination of claim 35 wherein said wire connecting means being a threaded screw member having a head thereon; said first and second said contact member each having a threaded hole therein for removably receiving said screw member therein.

38. An electric energy saving two-position switching device having no electrical "off" position and which is in electrical connected combination with one electric conducting wire member of substantially an electric cord member which is electrically connected to an electric incandescent table lamp fixture two-position switching means for a single filament incandescent lamp, comprising in combination: said electric said two-position switching device is substantially housed in a base portion of said fixture; said device having at least one single throw switching means and having a first and at least one second electrical conduction terminal member extending from an electric insulating housing portion thereof and having a switch actuation member extending from another portion thereof; said first and said second said conducting terminal member having a half-wave diode electric rectifying means electrically connected thereto for alternatingly providing a half-wave electric rectified "dim" and an electric full-wave "on" position of said switching device when said actuation member is manually actuated; said switching device being in electrical connected combination with said two-position electric switching means having electrical "off" and "on" switching positions for said incandescent lamp is so constructed and arranged that four separate combinations may be provided from said single filament said lamp and being "OFF", half-wave "DIM" and full-wave "ON"; "OFF", full-wave "ON" and half-wave "DIM"; "OFF" and half-wave "DIM" and "OFF" and full-wave "ON".

* * * * *